US006588155B1

(12) United States Patent
Theune et al.

(10) Patent No.: US 6,588,155 B1
(45) Date of Patent: Jul. 8, 2003

(54) DOOR FRAME WITH ADJUSTABLE GUSSET SYSTEM

(75) Inventors: Robert J. Theune, Dothan, AL (US); Blake S. Seymour, Dothan, AL (US); Oscar E. Hughes, Hartford, AL (US); Wendell E. Floyd, Dothan, AL (US); James R. Linville, Dothan, AL (US); David C. Allis, Dothan, AL (US)

(73) Assignee: Dunbarton Corporation, Dothan, AL (US)

( * ) Notice: Subject to any disclaimer, the term of this patent is extended or adjusted under 35 U.S.C. 154(b) by 36 days.

(21) Appl. No.: 09/910,627

(22) Filed: Jul. 20, 2001

(51) Int. Cl.[7] ..... E06B 1/20
(52) U.S. Cl. ..... 49/504; 49/505; 52/204.1
(58) Field of Search ..... 49/504, 505; 52/211, 52/717.01, 204.1; 70/466; 292/340, 341.18

(56) References Cited

U.S. PATENT DOCUMENTS

| | | | | | |
|---|---|---|---|---|---|
| 2,666,945 | A | | 1/1954 | Kelly | |
| 2,853,162 | A | | 9/1958 | David et al. | |
| 3,263,368 | A | | 8/1966 | Hildum et al. | |
| 3,265,427 | A | * | 8/1966 | Williams | 292/341.18 |
| 3,324,599 | A | * | 6/1967 | Brost | 49/505 |
| 3,416,829 | A | * | 12/1968 | Russell et al. | 292/341.19 |
| 3,564,774 | A | * | 2/1971 | Lickliter et al. | 49/504 |
| 3,721,055 | A | * | 3/1973 | Jerchower | 52/217 |
| 4,105,235 | A | * | 8/1978 | Thiel | 292/341.18 |
| 4,115,968 | A | * | 9/1978 | Majumdar | 49/504 |
| 4,635,399 | A | | 1/1987 | Gehrke et al. | |
| 5,154,019 | A | | 10/1992 | Day | |
| 5,257,841 | A | * | 11/1993 | Geringer et al. | 292/340 |
| 5,392,565 | A | | 2/1995 | Rentschler | |
| 5,757,269 | A | * | 5/1998 | Roth et al. | 340/542 |

* cited by examiner

*Primary Examiner*—Gregory J. Strimbu
(74) *Attorney, Agent, or Firm*—Smith, Gambrell & Russell, LLP

(57) ABSTRACT

A door frame and gusset system for adjustably attaching a strike plate to a door frame. The door frame includes an emboss indentation having slots and tabs. The tabs engage and align a gusset mounted on the back side of the door frame opposite the strike plate. The gusset has threaded holes for engaging screws which attach the strike plate to the gusset through the slots in the emboss indentation. The gusset also has slots which engage the tabs to allow the gusset to move horizontally with respect to the frame and prevent vertical movement of the gusset with respect to the frame. The slots in the emboss indentation allow relative movement of the gusset and strike plate with respect to the door frame to adjust the position of the strike plate. A separate dust box may also be incorporated between the gusset and the door frame. In addition, integral gusset and dust box assembly may be used in connection with the door frame and gusset system.

3 Claims, 6 Drawing Sheets

DOOR FRAME WITH ADJUSTABLE GUSSET SYSTEM

FIELD OF THE INVENTION

This invention relates to a door frame and gusset system, and more specifically relates to a door frame and gusset system for attaching a strike plate to the door frame to allow adjustment of the strike plate with respect to the door frame.

BACKGROUND OF THE INVENTION

Traditionally, doors are hung on wooden door frames by inserting screws through strike plates and hinges into the wood of the wall surrounding the door. Newer, industrial constructions, however, typically use metal door frames. The door frames are often thin-walled and thus do not have a solid background material for receiving a screw for mounting the strike plate or the hinges for the door.

Typically, manufacturers use a gusset behind a door frame for receiving the screws that support the strike plate and the hinge of a door mounted to the door frame. The gusset usually comprises a small plate of metal which is thicker than the door frame and which has formed or machined in screw holes which match the pattern of screw holes on the strike plate or the hinges. The holes in the gusset are tapped to receive the screws holding the strike plate or the door hinge.

The door frame generally includes an indentation (called "emboss indentation" in the art) for receiving the strike plate or the hinge of the door. Holes are included in the emboss indentation which match the screw hole pattern on the strike plate or hinge and the gusset. Before the frame is attached to the wall, the gusset is generally attached or held in place against the back side of this emboss indentation by some form of tab. When the gusset is placed on the tabs, the holes in the gusset, the holes in the emboss indentation, and holes in the strike plate or hinge are all aligned. After the gusset is in place, the door frame is attached to the wall. The door frame then stands ready for the attachment of a door, which simply requires inserting a screw through the strike plate or hinge, through the hole in the emboss indentation of the door frame, and into the tapped holes of the gusset.

With the door frame and gusset systems of the prior art, problems sometimes arise when mounting strike plates to the door frame. Particularly, once the strike plate has been mounted on an emboss indentation of the door frame, the latch on the door may not align with the opening in the strike plate in the transverse direction. If the strike plate is mounted too close to the door stop on the door frame, the door latch will not engage the opening of the strike plate, and door will not latch. If, on the other hand, the strike plate is mounted too far away from the door stop on the door frame, the door will latch loosely and may rattle against the door stop. If the strike plate is too close to the door stop, an installer may have to resorted to grinding the opening in the strike plate in order to accommodate the mismatched strike plate and door latch. If the strike plate is too far away from the door stop, the installer may have to install weatherstripping or other cushioning material on the door stop to accommodate the excess space and to thus prevent the door from rattling.

SUMMARY OF THE INVENTION

The present invention solves the above problems by providing a door frame and gusset system that accommodates transverse adjustment of a strike plate mounted on the door frame. The door frame and gusset system includes an emboss indentation on the door frame and a gusset mounted on the back side of the emboss indentation. The emboss indentation has slots and tabs. The tabs protrude rearwardly of the door frame. The slots are elongated in the transverse direction of the door frame and are aligned in the longitudinal direction with the holes in the strike plate. The gusset has threaded holes aligned to match the holes in the strike plate. The gusset also has gusset slots which engage the rearward protruding tabs of the emboss indentation.

In order to mount the strike plate onto the door frame, the gusset is first attached to the back side of the emboss indentation by means of the tabs of the emboss indentation engaging the gusset slots. The tabs are then bent to loosely secure the gusset to the door frame. When the gusset is thus attached to the back side of the door frame, the threaded holes in the gusset are in alignment with the slots in the emboss indentation in the longitudinally direction. The gusset slots, in engagement with the bent tabs, allows the gusset to slide transversely with respect to the emboss indentation, but not move longitudinally. Once the gusset is thus attached to the back side of the door frame by means of the bent tabs, the door frame is mounted to the wall which defines the door opening.

When the strike plate is subsequently mounted to the door frame, the holes in the strike plate aligned longitudinally with the slots in the emboss indentation and with the threaded holes in the gusset. With the holes in the strike plate aligned with the threaded holes in the gusset, screws are inserting to hold the strike plate to the door frame by means of the gusset. Because the slots in the emboss indentation extend transversely, both the gusset and strike plate can move transversely to thereby adjust the strike plate to ensure aligned engagement of the opening of the strike plate with the door latch. Once the proper alignment has been achieved, the screws are tightened, and the gussets holds the strike plate in the desired position.

The door frame and gusset system of the present invention also allows the use of a dust box with the door frame and strike plate. The dust box has elongated holes that aligned with the threaded holes in the gusset, the emboss indentation slots, and the holes in the strike plate. Consequently, the dust box is be positioned between the front side of the emboss indentation and the strike plate and held in place by the screws which hold the strike plate to the gusset. In an alternative embodiment of the present invention, the dust box and gusset may comprise an integral gusset and dust box assembly mounted on the back side of the door frame.

Therefore, it is an object of the present invention to provide an improved door frame and gusset system for mounting a strike plate.

It is a further object of the present invention to provide a door frame and gusset system for mounting a strike plate which accommodates transverse adjustment of the strike plate.

Further objects, features and advantages will become apparent upon consideration of the following detailed description of the invention when taken in conjunction with the drawing and the appended claims.

DETAILED DESCRIPTION OF THE PREFERRED EMBODIMENT

Figure 1:
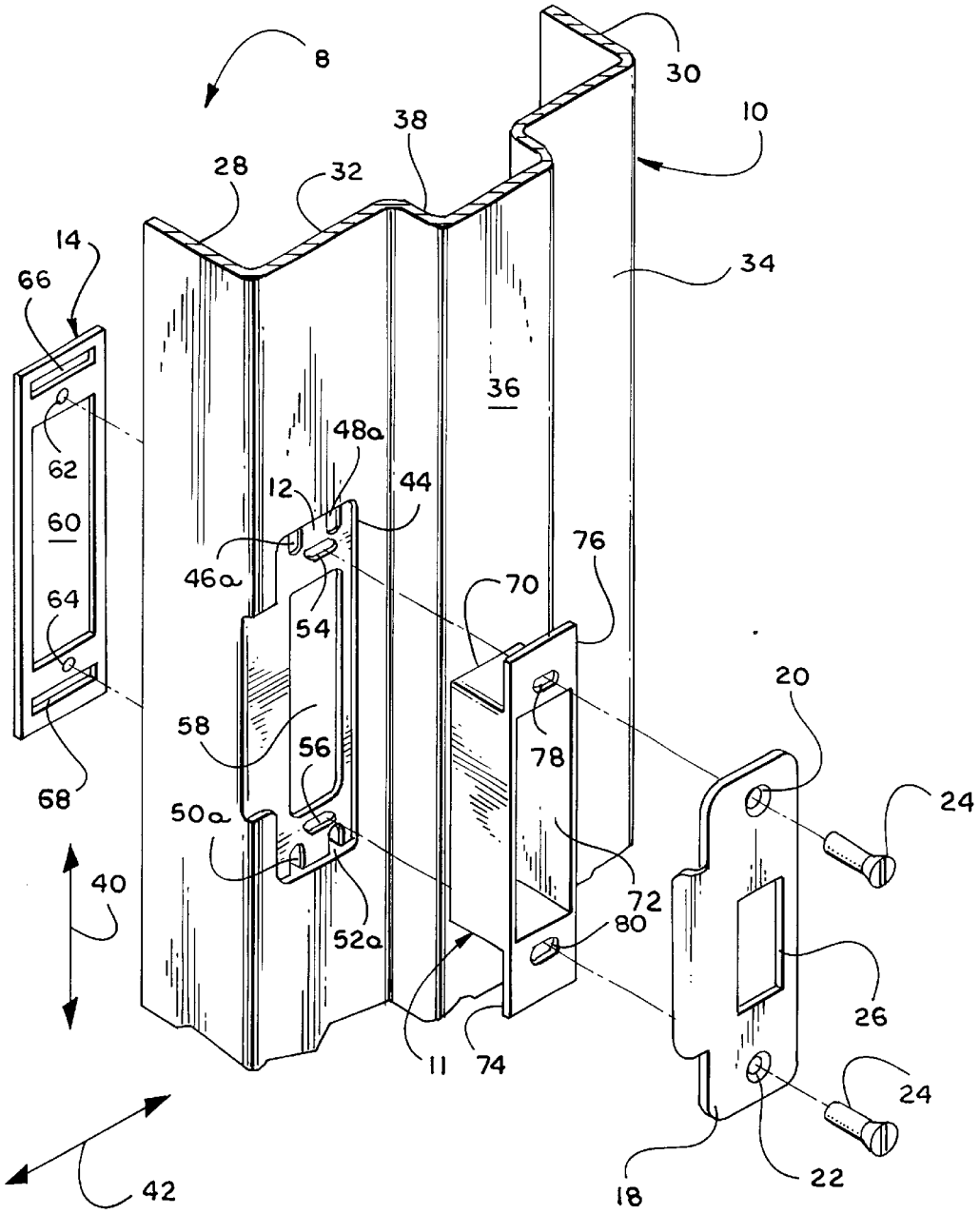
FIG. 1 is an exploded perspective view of door frame and gusset system for mounting a strike plate in accordance with the present invention.
Figure 2:
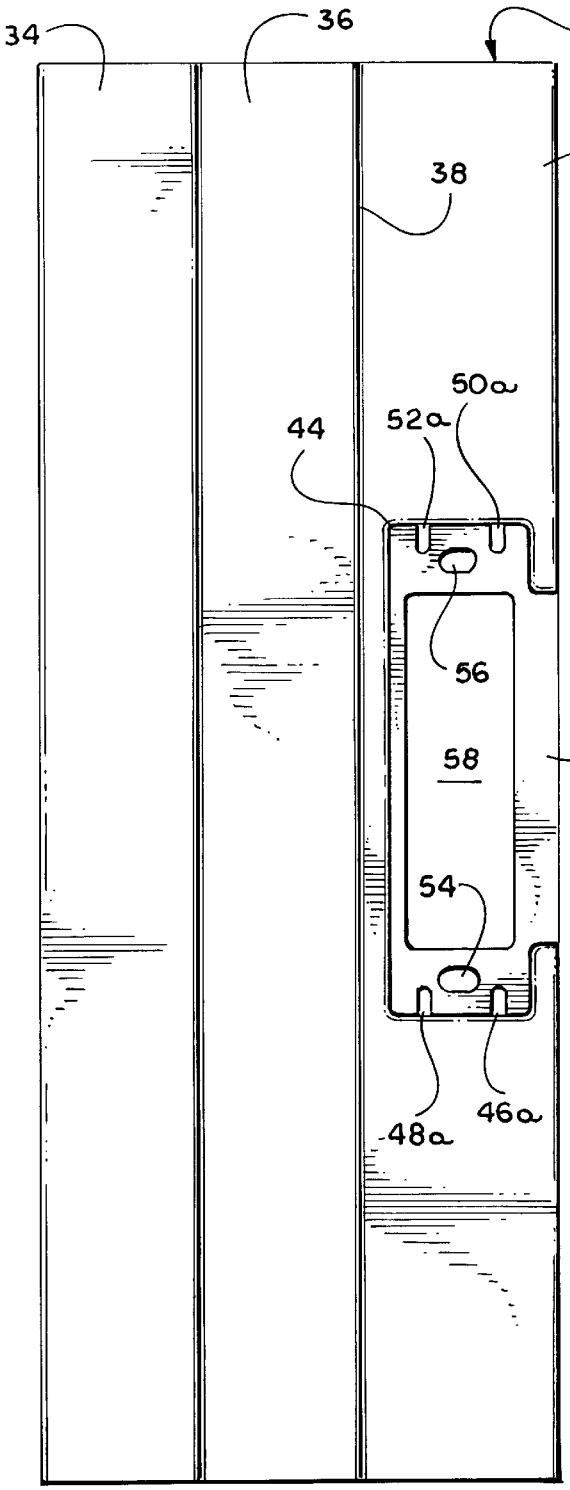
FIG. 2 is a front elevation view of the door frame with an emboss indentation in accordance with the present invention.
Figure 12:
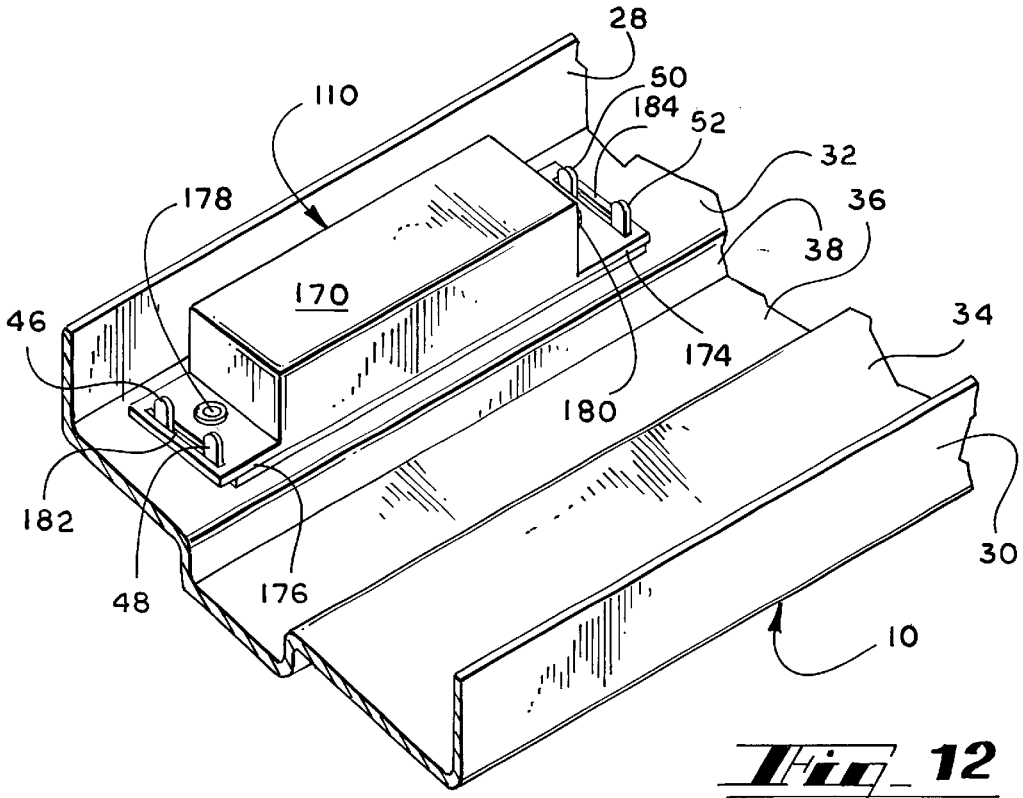
FIG. 12 is a back perspective view of the door frame with the integral gusset and dust box assembly mounted on the tabs of the emboss indentation in accordance with the present invention.

Referring now to the drawings, in which like reference numerals represent like parts throughout the several views, FIG. 1 discloses a door frame and gusset system 8 in accordance with the present invention. The door frame and gusset system 8 includes a door frame 10 having an emboss indentation 12 and a gusset 14. In one embodiment, the door frame and gusset system 8 may further include a separate dust box 11. In another embodiment, the door frame and gusset system 8 may include and integral gusset and dust box assembly 110 (FIG. 12). The door frame and gusset system 8 is used to mount a strike plate 18 to the door frame 10.

The strike plate 18 is a conventional strike plate which may be supplied by a number of manufacturers. The strike plate 18 has holes 20 and 22 which accommodate screws, such as screw 24, for mounting the strike plate 18 to the door frame 10. The strike plate 18 also has a square opening 26 which engages a door latch (not shown) in conventional fashion.

Except for the emboss indentation 12, the door frame 10 is conventional in construction and includes side flanges 28 and 30, facings 32 and 34, and door stop 36 having door abutting face 38. The door frame 10 may be either a knockdown door frame as illustrated in FIG. 1 or conventional hollow door frame as is known in the art. The present invention is useful in connection with both the hollow door frame and the knockdown door frame. The door frame 10 has a longitudinal direction 40 and a transverse direction 42. The side flanges 28 and 30 contact each side of a wall on the door latch side of a door opening. The back side of facings 32 and 34 contact the edge of the wall of the door opening, all in conventional fashion. The door frame 10 is conventionally constructed of steel, but other materials that may be formed as shown in FIG. 1 and that meet building code requirements are suitable for carrying out the present invention.

Figure 3:
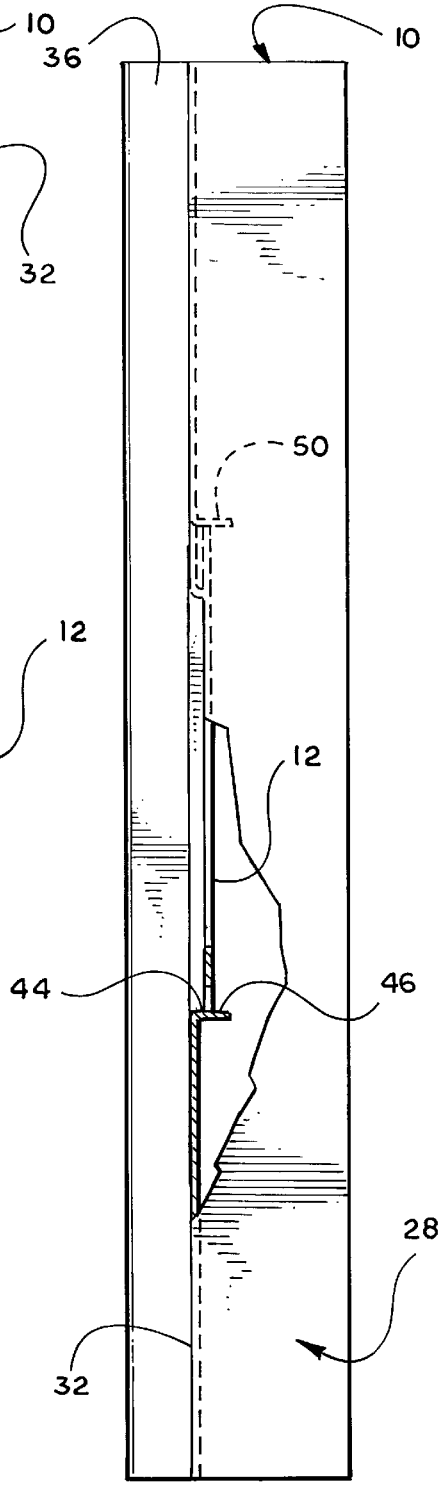
FIG. 3 is a side elevation view (partially broken away) of the door frame with the emboss indentation in accordance with the present invention.
Figure 4:
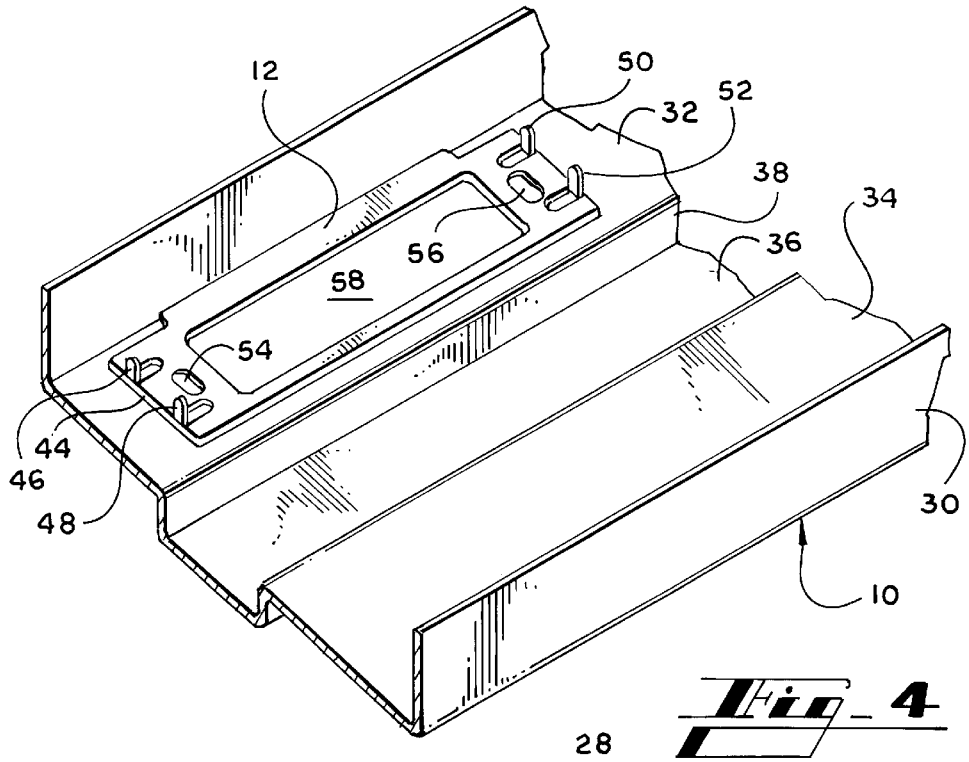
FIG. 4 is a back perspective view of the door frame with the emboss indentation in accordance with the present invention.

The emboss indentation 12 in the front facing 32 of the door frame 10 has a profile 44 which matches the outline of the strike plate 18. As can be seen from FIG. 3 and FIG. 4, the profile 44 of the emboss indentation 12 extends rearwardly of the facing 32 of the door frame 10. The emboss indentation 12 further includes tabs 46, 48, 50, and 52 (FIG. 4) with corresponding tabs holes 46*a*, 48*a*, 50*a*, and 52*a* (FIG. 1). In addition, the emboss indentation 12 has slots 54 and 56 which are elongated in the transverse direction 42 and which align in the longitudinal direction 40 with the holes 24 and 22 respectively of the strike plate 18. The emboss indentation 12 further has a latch accommodating opening 58.

The gusset 14 has a center opening 60, threaded holes 62 and 64, and gusset slots 66 and 68. The threaded holes 62 and 64 are aligned in the longitudinal direction 40 with the holes 20 and 22 respectively of the strike plate 18 as well as the slots 54 and 56 of the emboss indentation 12. The slots 66 and 68 align longitudinally with the tabs 46 and 48 and the tabs 50 and 52 respectively of the emboss indentation 12. Moreover, the holes 62 and 64 are threaded to accommodate the threads of the screws, such as screw 24. The gusset opening 60 is of a similar size to that of the opening 58 in the emboss indentation 12.

The dust box 11 comprises a closed rectangular box structure 70 with an opening 72. Flanges 74 and 76 are attached to either end of the rectangular box structure 70. The flanges 74 and 76 have enlarged holes 78 and 80 respectively. The rectangular box structure 70 is sized to fit within the opening 60 of the gusset 14. The opening 72 of the box structure 70 is sized to correspond with the opening 58 of the emboss indentation 12. The enlarged holes 78 and 80 are positioned to align longitudinally with the holes 20 and 22 of strike plate 18, with the slots 54 and 56 of the emboss indentation 12, and with the threaded holes 62 and 64 of the gusset 14.

Figure 5:
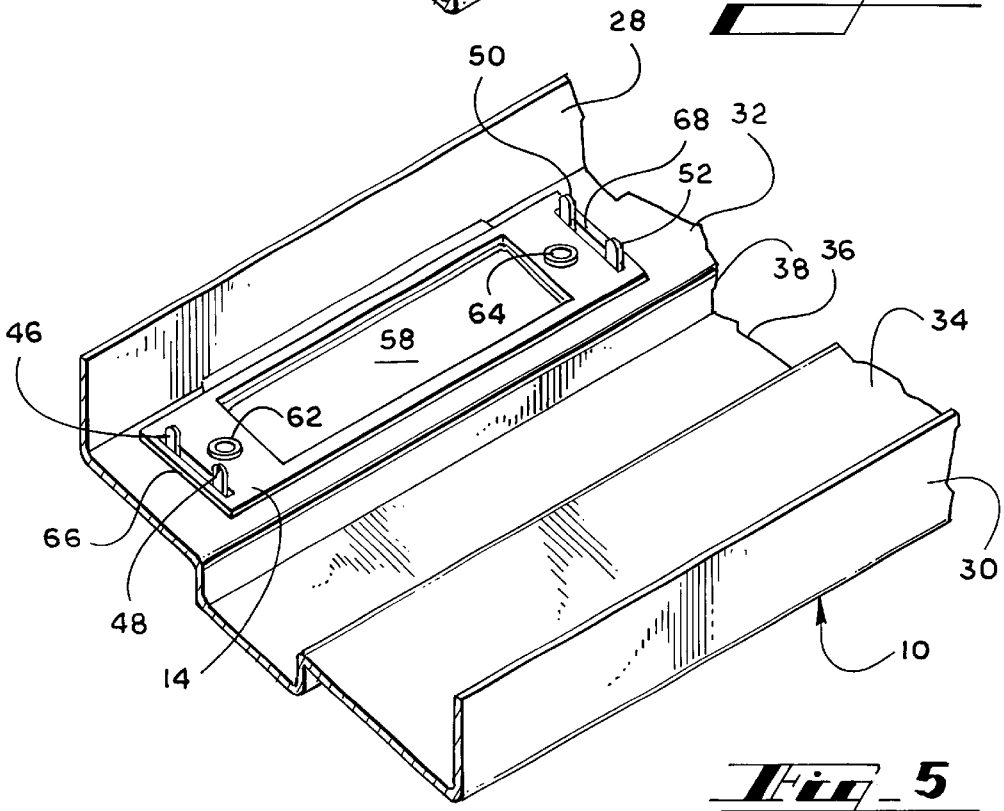
FIG. 5 is a back perspective view of the door frame with the gusset mounted on the tabs of the emboss indentation in accordance with the present invention.
Figure 6:
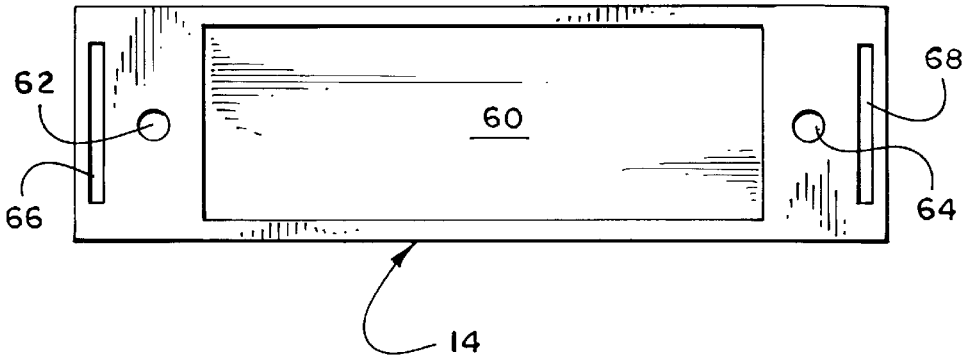
FIG. 6 is a plan view of the gusset in accordance with the present invention.
Figure 7:
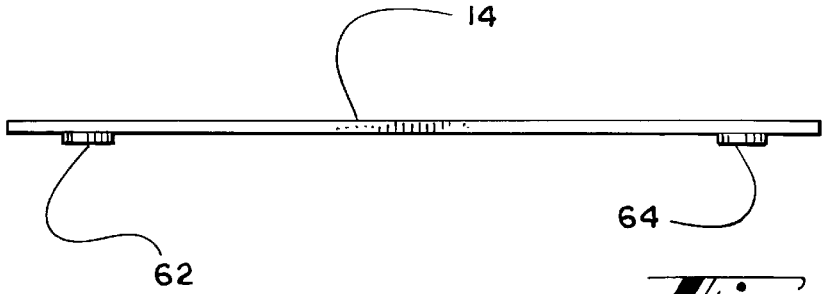
FIG. 7 is a side elevation view of the gusset in accordance with the present invention.
Figure 10:
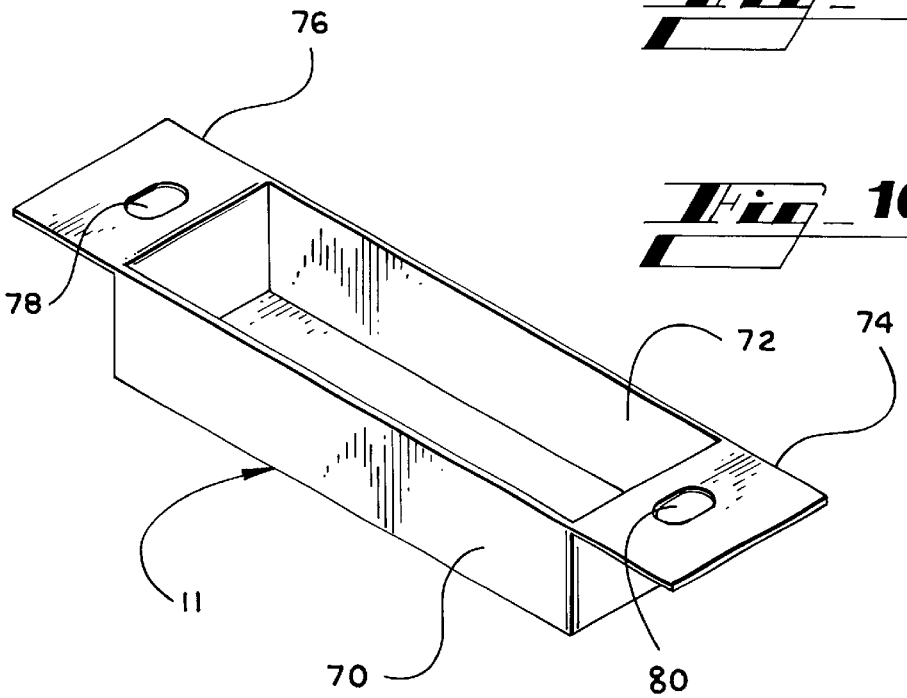
FIG. 10 is a perspective view of the dust box in accordance with the present invention.
Figure 8:
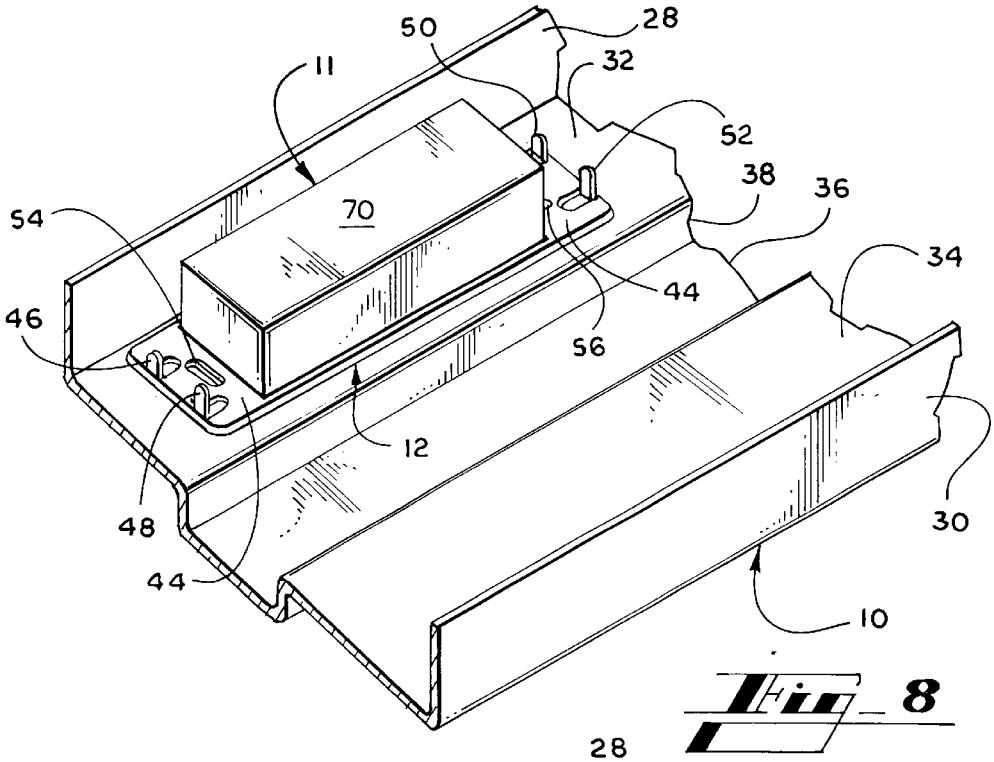
FIG. 8 is a back perspective view of the door frame with the dust box mounted on the tabs of the emboss indentation in accordance with the present invention.
Figure 9:
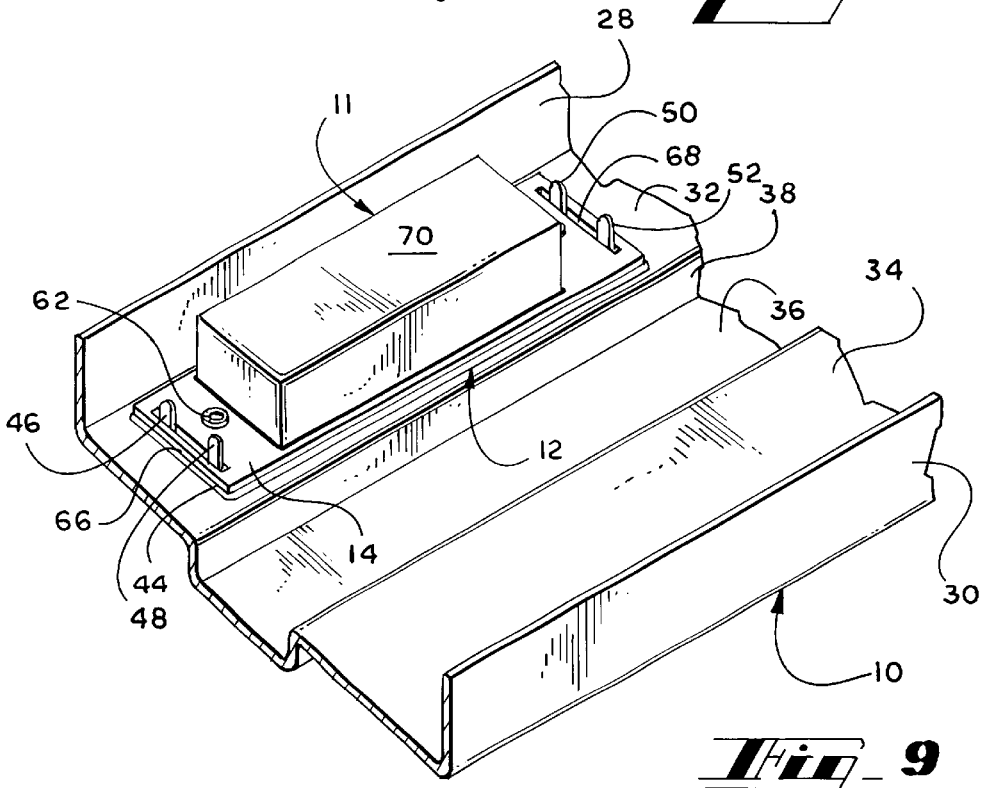
FIG. 9 is a back perspective view of the door frame with the dust box and; gusset mounted on the tabs of the emboss indentation in accordance with the present invention.

In accordance with the present invention, the strike plate 18 is mounted to the door frame 10 in the following manner. For an installation that does not include the dust box 11, the gusset 14 is the first placed over the tabs 46, 48, 50, and 52 on the back side of the emboss indentation 12 of the door frame 10 as shown in FIG. 5 and the tabs are bent to loosely hold the gusset 14 in place on the back of the door frame 10. With the gusset slots 66 and 68 of the gusset 14 thus engaged by the bent tabs 46, 48, 50, and 52, the door frame 10 is installed on the wall that defines the door opening. The side flanges 28 and 30 engage either side of the wall, and the facings 32 and 34 abutt the wall. With the door frame 10 thus mounted on the wall, the strike plate 18 is brought into positioned adjacent the emboss indentation 12 as shown in FIG. 1. The holes 20 and 22 of the strike plate 18 are aligned with the slots 54 and 56 of the emboss indentation 12 as well as the threaded holes 62 and 60 for of the gusset 14. Screws, such as screw 24, are inserted into the holes 20 and 22 of the strike plate 18 and engage the threaded holes 62 and 64 of the gusset 14. Because the slots 54 and 56 extend in the transverse direction 42 of the door frame 10, the screws, such as screw 24, can move within the slots 54 and 56 in the transverse direction 42. Likewise, because the gusset slots 66 and 68 are longer than the transverse distances defined by the tabs 46 and 48 and the tabs 50 and 52 respectively, the gusset 14 likewise can move in the transverse direction 42 but not in the longitudinal direction when the gusset 14 is connected by the screws to strike plate 18. If the door, when latch, is too lose and rattles when it is latched, the screws are loosened, and the strike plate is moved closer to the door abutting face 38. Likewise, if the door does not latch, the strike plate 18 is moved away from the door abutting face 38. In this way, the door frame and gusset system 8 can accommodate adjustment of the door to assure a tight latch.

For an installation that includes the separate dust box 11, the gusset 14 and the door frame 10 are installed as previously described. Once the door frame 10 and attached gusset 14 are installed in the door opening, the dust box 11 is inserted from the front side of the door frame 10 through the opening 58 of the emboss indentation 12 and through the opening 60 of the attached gusset 14. The slotted holes 78 and 80 of the dust box 11 coincided with the slotted holes 54 and 56 of the emboss indentation 12. Next the holes 20 and 22 of the strike plate 18 are aligned with the slots 78 and 80 of the dust box 11, the slots 54 and 56 of the emboss indentation 12, and the threaded holes 62 and 60 for of the gusset 14. Screws, such as screw 24, are inserted into the holes 20 and 22 of the strike plate 18 and engage the threaded holes 62 and 64 of the gusset 14 to hold the strike plate 18 and the dust box 11 in place.

Figure 11:
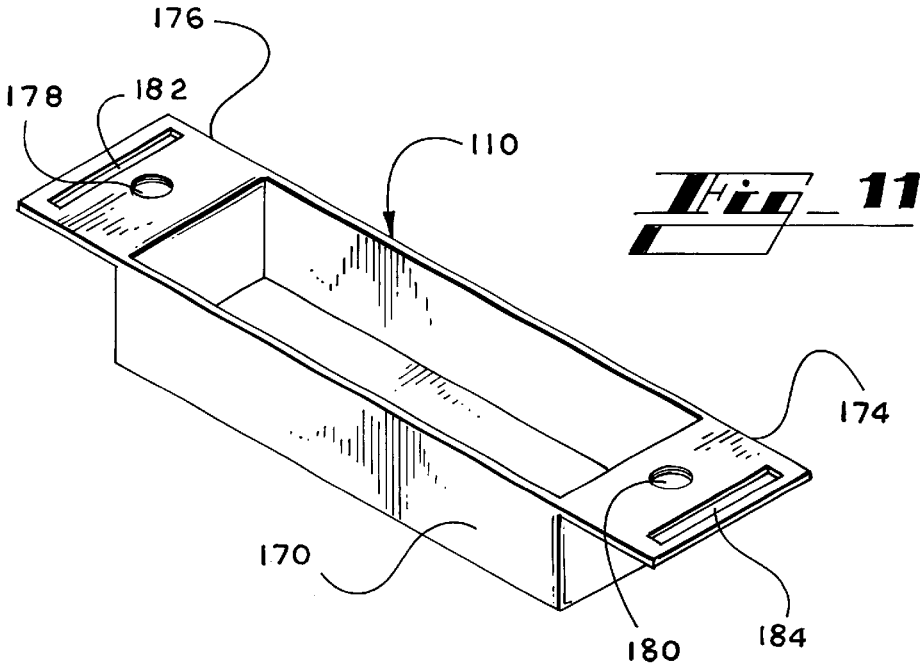
FIG. 11 is a perspective view of an integral gusset and dust box assembly in accordance with the present invention.

In another embodiment of the present invention, the integral gusset and dust box assembly 110 is shown in FIG. 11. The integral gusset and dust box assembly 110 comprises a closed rectangular box structure 170 with an opening 172. Flanges 174 and 176 are attached to either end of the rectangular box structure 170. The flanges 174 and 176 constitute the gusset portion of the gusset and dust box assembly and have threaded holes 178 and 180 respectively as well as slots 182 and 184 respectively. The rectangular box structure 170 and the opening 172 of the box structure 170 are sized to correspond with the opening 58 of the emboss indentation 12. The threaded holes 178 and 180 are positioned to align longitudinally with the holes 20 and 22 of strike plate 18 and with the slots 54 and 56 of the emboss indentation 12. The slots 182 and 184 are positioned to align with and to engage the tabs 46 and 48 and the tabs 50 and 52 of the emboss indentation 12, respectively.

For an installation of the integral gusset and dust box assembly 110, the gusset and dust box assembly 110 is first placed over the tabs 46, 48, 50, and 52 and engages the tabs by means of the gusset and dust box assembly slots 182 and 184 as shown in FIG. 12. Once the integral gusset and dust box assembly 10 is mounted on the tabs 46, 48, 50, and 52, as shown in FIG. 12, the holes 20 and 22 of the strike plate 18 are aligned with the slots 54 and 56 of the emboss indentation 12 (FIG. 1) as well as the threaded holes 178 and 180 of the gusset and dust box assembly 110. Screws, such as screw 24, are inserted into the holes 20 and 22 of the strike plate 18, through slots 54 and 56 of the emboss indentation 12 (FIG. 1), and engage the threaded holes 178 and 180 of the gusset and dust box assembly 110. Because the slots 54 and 56 extend in the transverse direction 42 of the door frame 10, the screws, such as screw 24, can move within the slots 54 and 56 in the transverse direction 42. Likewise, because the gusset and dust box assembly slots 182 and 184 are longer than the transverse distances defined by the tabs 46 and 48 and the tabs 50 and 52 respectively, the gusset and dust box assembly 110 likewise can move in the transverse direction 42 when the gusset and dust box assembly 110 is connected by the screws to strike plate 18. If the door, when latch, is too lose and rattles when it is latched, the screws are loosened, and the strike plate is moved closer to the door abutting face 38. Likewise, if the door does not latch, the strike plate 18 is moved away from the door abutting face 38. In this way, the door frame and gusset system 8 with the integral gusset and dust box assembly 110 can accommodate adjustment of the door to assure a tight latch.

While this invention has been described with reference to preferred embodiments thereof, it is to be understood that variations and modifications can be affected within the spirit and scope of the invention as described herein and before and as described in the appended claims.

We claim:

1. A door frame and gusset system comprising:

a. a door frame having a front side, a back side, a longitudinal direction, and a transverse direction;

b. an emboss indentation in the door frame comprising:

i. embossed slots aligned longitudinally with mounting holes of a strike plate and extending in the transverse direction of the door frame; and ii. embossed tabs formed homogeneously with and extending backwardly from the back side of the door frame; and c. a gusset having threaded holes that align longitudinally with the mounting holes of the strike plate and transversely extending gusset plate slots that engage the tabs so that longitudinal movement of the gusset is prevented and transverse movement of the gusset is accommodated.

2. The door frame and gusset system of claim 1, wherein the door frame and gusset system further includes a dust box having dust box slots that align longitudinally with the holes of the gusset so that longitudinal movement of the dust box with respect to the gusset is restricted and transverse movement of the dust box with respect to the gusset is accommodated.

3. A door frame and gusset system comprising:

a. a door frame having a front side, a back side, a longitudinal direction, and a transverse direction;

b. an emboss indentation in the door frame comprising:

i. embossed slots aligned longitudinally with mounting holes of a strike plate and extending in the transverse direction of the door frame; and ii. embossed tabs extending backwardly from the back side of the door frame; and c. an integral gusset and dust box assembly having threaded holes that align longitudinally with the mounting holes of the strike plate and having transversely extending slots that engage the tabs so that longitudinal movement of the gusset and dust box assembly is prevented and transverse movement of the gusset and dust box assembly is accommodated.

* * * * *